US008349199B2

(12) United States Patent
Jeong et al.

(10) Patent No.: US 8,349,199 B2
(45) Date of Patent: Jan. 8, 2013

(54) INK FEEDHOLE OF INKJET PRINTHEAD AND METHOD OF FORMING THE SAME

(75) Inventors: Yong-won Jeong, Seoul (KR); Yong-seop Yoon, Seoul (KR); Moon-chul Lee, Seongnam-si (KR); Dong-sik Shim, Suwon-si (KR); Jong-seok Kim, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 456 days.

(21) Appl. No.: 12/544,422

(22) Filed: Aug. 20, 2009

(65) Prior Publication Data

US 2010/0171793 A1 Jul. 8, 2010

(30) Foreign Application Priority Data

Jan. 6, 2009 (KR) ..... 10-2009-0000848

(51) Int. Cl.
*B41J 2/14* (2006.01)
*B44C 1/22* (2006.01)

(52) U.S. Cl. ..... 216/27; 216/41; 216/58

(58) Field of Classification Search ..... 216/17, 216/27, 41, 58
See application file for complete search history.

(56) References Cited

U.S. PATENT DOCUMENTS

| | | | | |
|---|---|---|---|---|
| 5,387,314 | A * | 2/1995 | Baughman et al. | 216/27 |
| 6,866,790 | B2 * | 3/2005 | Milligan et al. | 216/27 |
| 6,875,365 | B2 * | 4/2005 | Watanabe et al. | 216/2 |
| 7,238,293 | B2 * | 7/2007 | Donaldson et al. | 216/27 |
| 7,560,039 | B2 * | 7/2009 | Krawczyk et al. | 216/27 |
| 2009/0065472 | A1 * | 3/2009 | Asai et al. | 216/27 |

* cited by examiner

*Primary Examiner* — Shamim Ahmed
(74) *Attorney, Agent, or Firm* — Stanzione & Kim, LLP

(57) ABSTRACT

An ink feedhole of an inkjet printhead and a method of forming the same includes an ink feedhole that penetrates a substrate and has a width that narrows in an upper direction of the substrate, wherein at least one internal wall of the ink feedhole has a plurality of steps and inclines with respect to a surface of the substrate.

14 Claims, 13 Drawing Sheets

INK FEEDHOLE OF INKJET PRINTHEAD AND METHOD OF FORMING THE SAME

CROSS-REFERENCE TO RELATED APPLICATIONS

This application claims priority under 35 USC §119 from Korean Patent Application No. 10-2009-0000848, filed on Jan. 6, 2009, in the Korean Intellectual Property Office, the disclosure of which is incorporated herein in its entirety by reference.

BACKGROUND

1. Field of the General Inventive Concept

The present general inventive concept relates to an inkjet printhead, and more particularly, to an ink feedhole of an inkjet printhead and a method of forming the same.

2. Description of the Related Art

An inkjet printhead is an apparatus for forming an image with predetermined colors by discharging minute ink droplets on desired locations of a printing medium. Inkjet printheads may be classified into two types according to a discharging mechanism of ink droplets. A first type is a thermal inkjet printhead that ejects ink droplets by the expansive force of bubbles generated in ink by a heating source, and a second type is a piezoelectric inkjet printhead that ejects ink droplets by applying pressure to ink via deforming a piezoelectric substance.

The discharging mechanism of ink droplets in a thermal inkjet printhead will now be described in detail. When a pulse current flows through a heater formed of resistance heating elements, heat is generated in the heater, and thus, ink adjacent to the heater is quickly heated up to about 300° C. Accordingly, the ink boils and thus bubbles are generated. The generated bubbles expand, and pressurize an ink chamber filled with ink. Consequently, ink near a nozzle is ejected outside of the ink chamber as droplets. The inkjet printhead may have a structure in which a chamber layer and a nozzle layer are sequentially stacked on a substrate. Here, the substrate is generally formed of silicon. The chamber layer includes a plurality of ink chambers filled with ink to be discharged, and the nozzle layer includes a plurality of nozzles discharging ink. Also, an ink feedhole that supplies ink to the ink chambers penetrates the substrate.

Examples of a method of forming an ink feedhole of an inkjet printhead include a method of wet-etching a substrate and a method of dry-etching a substrate. In the method of wet-etching a substrate, a wet-etching process is performed on a surface of the substrate at an inclination of about 54.7°, and thus a width of an ink feedhole penetrating the substrate may be up to about 5 times wider at a rear surface of the substrate than at a front surface of the substrate. Accordingly, a relatively large area of the substrate is removed during the wet-etching process, and thus hardness of an inkjet printhead including the ink feedhole formed via the method of wet-etching a substrate may decrease. Meanwhile, in the method of dry-etching a substrate, a dry-etching process is performed in a perpendicular direction with respect to a surface of the substrate, and thus an ink feedhole having a uniform width may penetrate the substrate. Accordingly, when dry-etching, an area of the substrate that is etched is smaller than that formed in the method of wet-etching a substrate and thus hardness of an inkjet printhead increases. Also, in an inkjet printhead including a uniform width ink feedhole, bubbles generated by heat from a heater may be trapped in the ink feedhole having a narrow width while discharging ink, and thus it may be difficult to discharge the trapped bubbles. Such trapped bubbles may prevent ink from moving from the ink feedhole to an ink chamber, and thus a discharge characteristic may deteriorate.

SUMMARY

The present general inventive concept provides an ink feedhole of an inkjet printhead and a method of forming the same to improve hardness and ejection characteristics of the inkjet printhead.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an ink feedhole of an inkjet printhead that penetrates a substrate and has a width that narrows in an upper direction of the substrate, wherein at least one internal wall of the ink feedhole may have a plurality of steps and inclines with respect to a surface of the substrate.

An angle of inclination of the at least one internal wall may be in a range from about 54.7° to about 90° with respect to the surface of the substrate.

Internal walls of the ink feedhole that face each other symmetrically may incline with respect to a central surface between the internal walls. One of the internal walls, which face each other is perpendicular to a surface of the substrate, and the other internal wall may incline with respect to a surface of the substrate.

The foregoing and/or other aspects and utilities of the present general inventive concept may also be achieved by providing an inkjet printhead including a substrate that includes an ink feedhole that penetrates the substrate and has a width narrowing in an upper direction of the substrate, a chamber layer that is stacked on the substrate and includes a plurality of ink chambers; and a nozzle layer that is stacked on the chamber layer and includes a plurality of nozzles, wherein at least one internal wall of the ink feedhole has a plurality of steps and inclines with respect to a surface of the substrate.

The inkjet printhead may further include: an insulation layer that is formed on a top surface of the substrate, a plurality of heaters and electrodes formed sequentially on the insulation layer, and a passivation layer that is formed to cover the plurality of heaters and electrodes.

The foregoing and/or other aspects and utilities of the present general inventive concept may be achieved by providing a method of forming an ink feedhole that penetrates a substrate and has a width narrowing in an upper direction of the substrate, wherein at least one internal wall of the ink feedhole may be formed to have a plurality of steps and incline with respect to a surface of the substrate via dry-etching.

The method may include: coating a photoresist on a bottom surface of the substrate; preparing a photomask that includes areas having different light transmittances from each other below the photoresist; exposing the photoresist to light via the photomask and developing the photoresist; and dry-etching the substrate using the developed photoresist as an etching mask.

The developed photoresist may include a plurality of steps to correspond to the areas having different light transmittances from each other.

The dry-etching may be inductively coupled plasma-reactive ion etching (ICP-RIE).

The foregoing and/or other aspects and utilities of the present general inventive concept may be achieved by providing a method of manufacturing an inkjet printhead, the method including, forming a chamber layer including a plurality of ink chambers, on a substrate, forming a sacrificial layer filling the ink chambers, forming a nozzle layer including a plurality of nozzles on top surfaces of the chamber layer and the sacrificial layer, and forming an ink feedhole having a width narrowing in an upper direction of the substrate, by etching the substrate, wherein at least one internal wall of the ink feedhole is formed to have a plurality of steps and incline with respect to a surface of the substrate via dry-etching.

The forming of the ink feed hole may include: coating a photoresist on a bottom surface of the substrate; preparing a photomask that includes areas having different light transmittances from each other below the photoresist; exposing the photoresist to light using the photomask, and developing the photoresist, and dry-etching the substrate using the developed photoresist as an etching mask.

The method may further include removing the sacrificial layer, after forming the ink feedhole.

The method may further include forming an insulation layer on the substrate; forming, sequentially, a plurality of heaters and electrodes on the insulation layer, and forming a passivation layer covering the plurality of heaters and electrodes. The method may further include forming a trench that exposes the substrate, by etching the passivation layer and the insulation layer.

The foregoing and/or other aspects and utilities of the present general inventive concept may also be achieved by providing an inkjet printhead apparatus including a substrate having an ink feedhole formed in a first direction, the ink feedhole being narrowed in the direction, and a unit formed on the substrate to receive ink through the ink feedhole and to eject the received ink.

The substrate may include a surface to define the ink feedhole and the surface may include a plurality of protrusions to extend a length of the feedhole.

The substrate may include a surface to define the ink feedhole, the surface of the substrate including a plurality of steps having different dimensions and the plurality of steps extend in a second direction perpendicular to the first direction.

The steps may include a plurality of concave and convex portions that extend a length of the feedhole.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE EMBODIMENTS

Figure 1:
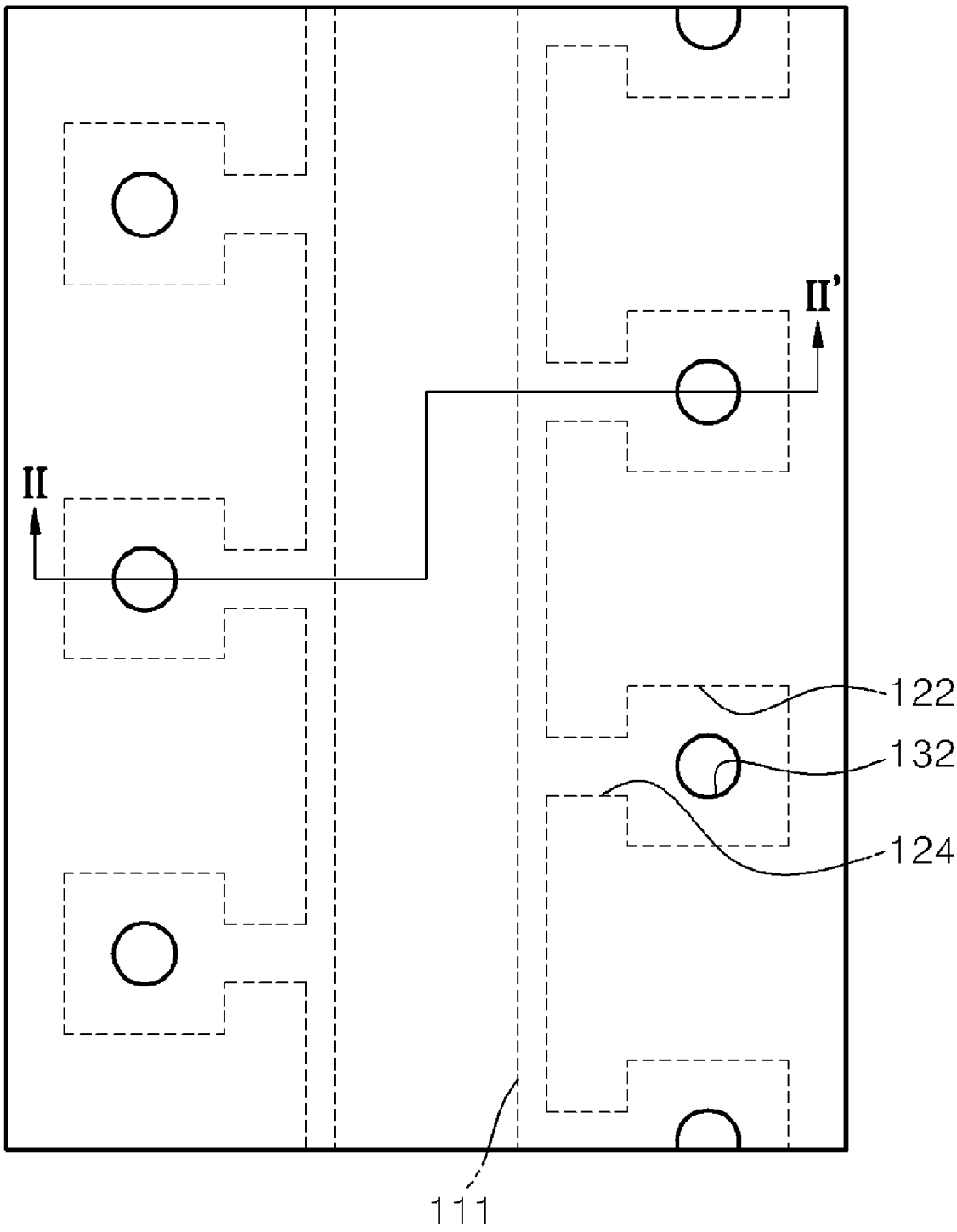
FIG. 1 is a plan view schematically illustrating an inkjet printhead according to an embodiment of the present general inventive concept.

The present general inventive concept will now be described more fully with reference to the accompanying drawings, in which exemplary embodiments of the present general inventive concept are illustrated. In the drawings, like reference numerals denote like elements, and the sizes and thicknesses of elements may be exaggerated for clarity. The present general inventive concept may be embodied in many different forms. For example, when a layer is referred to as being "on" another layer or substrate, it can be directly on the other layer or substrate, or intervening layers may also be present. Also, each element of an inkjet printhead may be formed of materials different from described materials, and an order of performing operations of a method of forming an inkjet printhead may be different from a described order herein.

Figure 2:
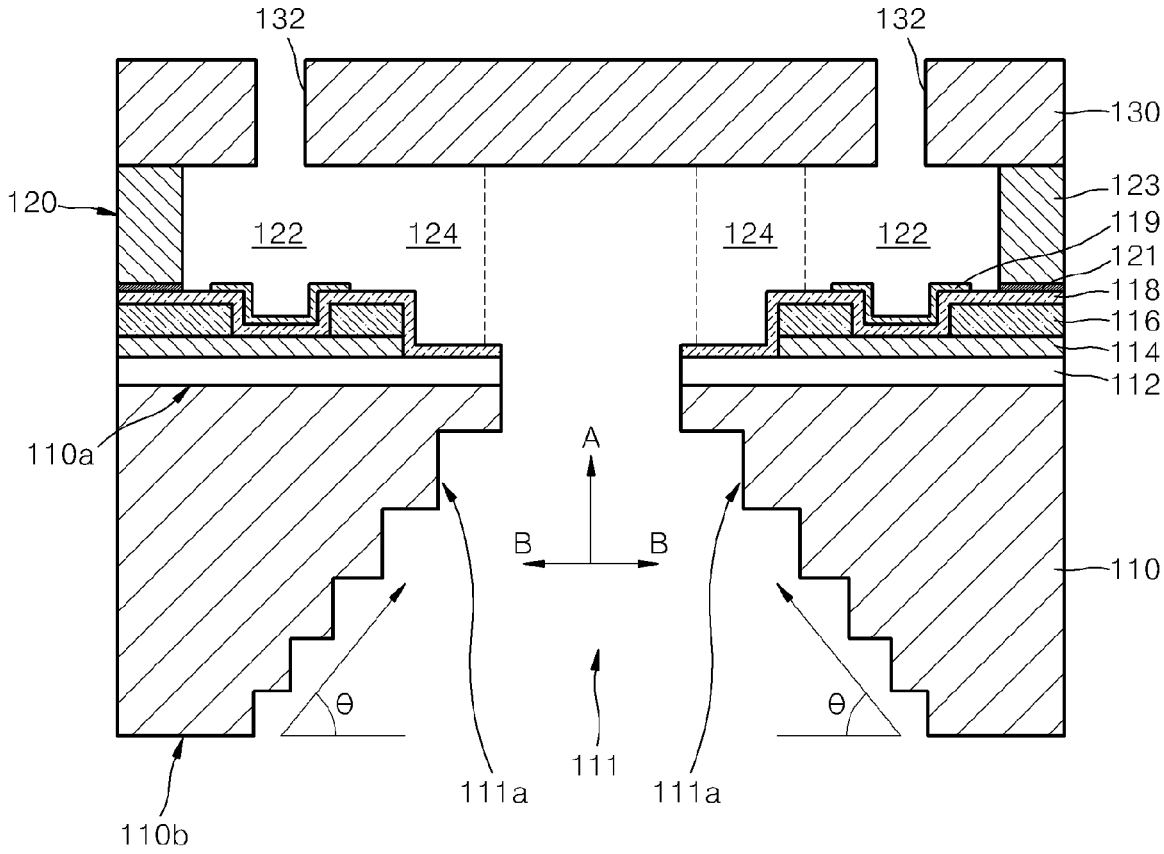
FIG. 2 illustrates a cross-sectional view taken along a line II-II' of FIG. 1.

FIG. 1 is a plan view schematically illustrating an inkjet printhead according to an embodiment of the present general inventive concept. FIG. 2 is a cross-sectional view taken along a line II-II' of FIG. 1.

Referring to FIGS. 1 and 2, the inkjet printhead according to the current embodiment includes a substrate 110 with an upper/front surface 110*a* and a lower/back surface 110*b*, a chamber layer 120 including a barrier 123 stacked on the substrate 110, and a nozzle layer 130 stacked on the chamber layer 120. The barrier 123 may be formed of silicon oxide, polysilicon, metal oxides, metal nitrides, or other known barrier materials that may resist or prevent leakage of ink outside of the chamber layer 120. The substrate 110 may be formed of silicon, and an ink feedhole 111 penetrates the substrate 110. The chamber layer 120 includes a plurality of ink chambers 122 and the nozzle layer 130 includes a plurality of nozzles 132.

An insulation layer 112 may be formed on a top surface of the substrate 110 so as to insulate the substrate 110 from heaters 114 that will be described later. Here, the insulation layer 112 may be formed of, for example, a silicon oxide. The plurality of heaters 114 may generate bubbles by heating ink in the ink chambers 122 and may be formed on a top surface of the insulation layer 112. Here, the heaters 114 may be disposed on or near bottom surfaces of the ink chambers 122. The heaters 114 may be formed of a heating resistor such as, for example, a tantalum-aluminum alloy, a tantalum nitride, a titanium nitride, a tungsten silicide, and other transition metal alloys, nitrides, or silicides, but is not limited thereto. Also, electrodes 116 may be formed on top surfaces of the heaters 114. The electrodes 116 may supply current to the heaters 114, and may be formed of a material having excellent conductivity. The electrodes 116 may be formed of, for example, aluminum (Al), an aluminum alloy, gold (Au), copper (Cu), silver (Ag), or alloys thereof, but is not limited thereto.

A passivation layer 118 may be formed on the top surfaces of the heaters 114 and the electrodes 116. Here, the passivation layer 118 prevents ink from oxidizing or corroding the heaters 114 or the electrodes 116, and may be formed of a silicon nitride or a silicon oxide. Anti-cavitation layers 119 may be formed on a top surface of the passivation layer 118 that are disposed on the top surfaces of the heaters 114. Here, the anti-cavitation layers 119 protect the heaters 114 from cavitation force generated when the bubbles generated by the heaters 114 disappear, and may be formed of, for example, tantalum (Ta) or other transition metals. Furthermore, a glue layer 121 may be formed on the passivation layer 118 so that the barrier 123 in the chamber layer 120 and the passivation layer 118 are strongly adhered to each other.

The barrier 123 in the chamber layer 120 may be stacked on the passivation layer 118. The chamber layer 120 includes the ink chambers 122 filled with ink supplied from the ink feedhole 111. The chamber layer 120 may further include a plurality of restrictors 124 that are paths connecting the ink feedhole 111 and the ink chambers 122. Also, the nozzle layer 130 includes the nozzles 132, which discharge ink.

In an exemplary embodiment, a width of the ink feedhole 111 penetrating the substrate 110 narrows in a first upper direction A of the substrate 110. That is, the width of the feedhole 111 is wider at the back surface 110*b* of the substrate 110 and gets narrower toward the front surface 110*a* of the substrate 110. Also, internal walls 111*a* of the ink feedhole 111 that face each other each have a plurality of steps that extend in a second direction B perpendicular to the first direction A, and incline at a predetermined angle θ with respect to a surface of the substrate 110. Here, the angle θ of the internal walls of the ink feedhole 111 is in a range from about 54.7° to about 90°. However, the angle θ is not limited thereto, and may be variously adjusted. Here, the internal walls may be formed symmetrically with respect to a central surface between the internal walls. Such inclined internal walls of the ink feedhole 111 may be formed by dry-etching the substrate 110 by using a gray scale etching mask 150 of FIG. 7 as will be described later.

As in the current embodiment, since the width of the ink feedhole 111 narrows in the upper direction of the substrate 110, the bubbles generated while discharging the ink may not be trapped in the ink feedhole 111 but may be discharged. Accordingly, ink easily flows from the ink feedhole 111 to the ink chambers 122, and thus an ink discharge characteristic increases. Also, when the internal walls of the ink feedhole 111 incline at an angle higher than about 54.7°, the inkjet printhead may have a stronger structure compared to that of when an ink feedhole is formed by using wet-etching.

Figure 3:
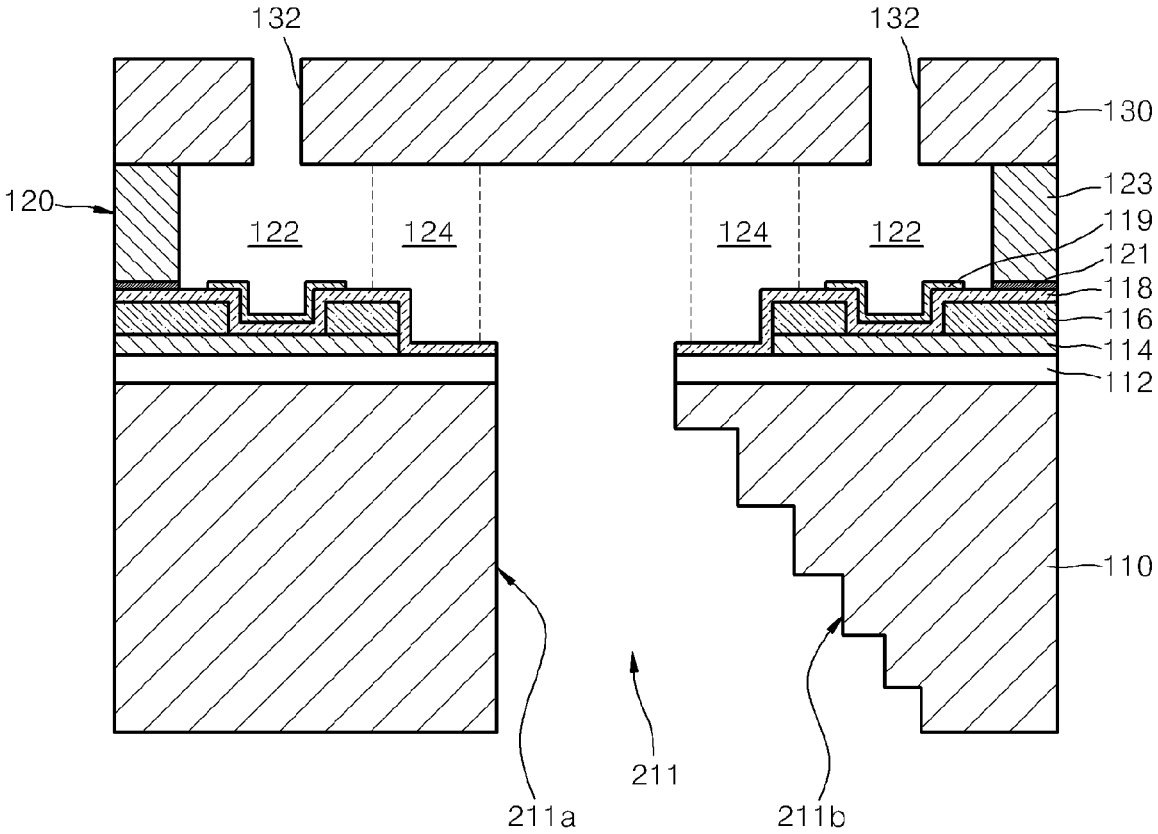
FIG. 3 illustrates a cross-sectional view of an inkjet printhead according to another embodiment of the present general inventive concept.

FIG. 3 is a cross-sectional view of an inkjet printhead according to another embodiment of the present general inventive concept. The inkjet printhead of FIG. 3 is identical to the inkjet printhead of FIG. 2, except for a shape of an ink feedhole.

Referring to FIG. 3, an ink feedhole 211 to supply ink penetrates the substrate 110. A width of the ink feedhole 211 narrows along an upper direction of the substrate 110. Also, internal walls 211*a* and 211*b* of the ink feedhole 211 that face each other may be formed asymmetrically with respect to a central surface between the internal walls. In detail, the internal wall 211*a* of the ink feedhole 211 may be perpendicular to a surface of the substrate 110, and the other internal wall 211*b* may incline with respect to a surface of the substrate 110. Here, the inclined internal wall 211*b* of the ink feedhole 211 may include a plurality of steps and incline at a predetermined angle of greater than or equal to 54.7 degrees. The predetermined angle may vary. In the current embodiment, the internal walls of the ink feedhole 211 are formed asymmetrically, where the internal wall 211*a* is perpendicular to a surface of the substrate 110 and the other internal wall 211*b* inclines at a predetermined angle with respect to a surface of the substrate 110. However, the internal walls of the ink feedhole 211 are not limited thereto, and may be asymmetrically formed at different angles of inclination, including switching the positioning of the perpendicular and inclined internal walls.

A method of manufacturing the inkjet printhead described above will now be described. FIGS. 4 through 13 are diagrams illustrating the method according to an embodiment of the present general inventive concept.

Figure 4:
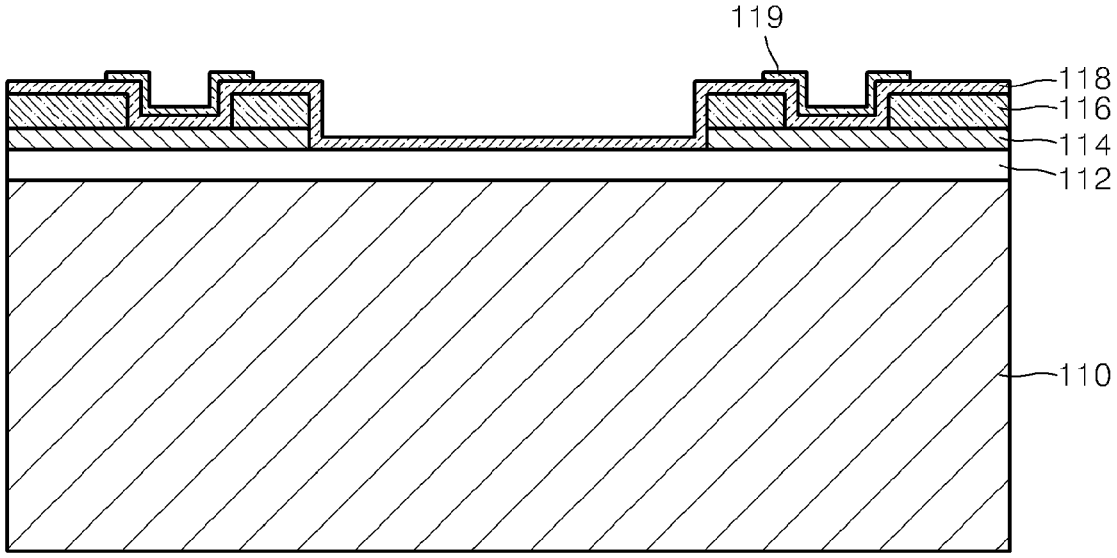
FIGS. 4 through 13 are diagrams illustrating a method of manufacturing an inkjet printhead, according to embodiments of the present general inventive concept.

Referring to FIG. 4, the substrate 110 is prepared, and then the insulation layer 112 is formed on the top surface of the substrate 110. The substrate 110 may be formed of, for example, silicon. The insulation layer 112 insulates the substrate 110 from the heaters 114, and may be formed of, for example, a silicon oxide. Then, the plurality of heaters 114, which generate bubbles by heating ink, are formed on the top surface of the insulation layer 112. The heaters 114 may be formed by depositing a heating resistor including transition metals, such as, for example, a tantalum-aluminum alloy, a tantalum nitride, a titanium nitride, or a tungsten silicide, on the top surface of the insulation layer 112, and then patterning the heating resistor. Next, electrodes are formed on the top surfaces of the heaters 114. The electrodes 116 may be formed by depositing a metal having excellent conductivity, such as, for example, aluminum, an aluminum alloy, gold, copper, silver, or alloys thereof on the top surfaces of the heaters 114, and the patterning the metal. The electrodes 116 may also be formed by selective deposition and other processes known to those of ordinary skill in the art.

The passivation layer 118 is formed on the insulation layer 112 so as to cover the heaters 114 and the electrodes 116. The passivation layer 118 prevents ink from oxidizing or corroding the heaters 114 and the electrodes 116, and may be formed of, for example, a silicon nitride or a silicon oxide. Furthermore, the anti-cavitation layers 119 may be formed on the top surface of the passivation layer 118 disposed on the top surfaces of the heaters 114. The anti-cavitation layers 119 protect the heaters 114 from cavitation force generated when the bubbles generated by the heaters disappear, and may be formed of, for example, tantalum or other transition metal.

Figure 5:
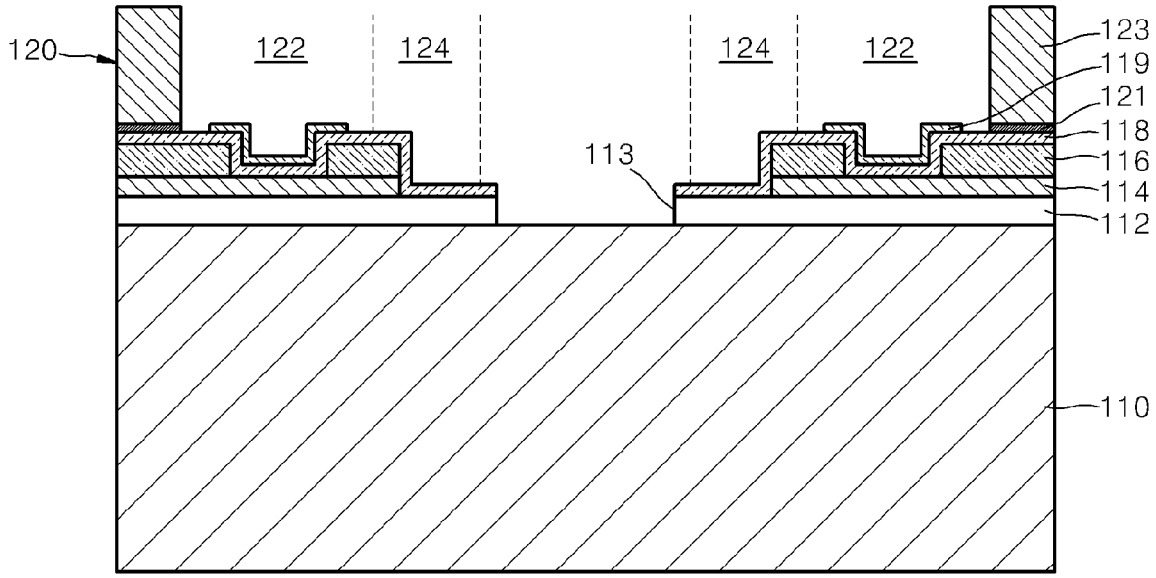

Furthermore, referring to FIG. 5, the glue layer 121 may be formed on the passivation layer 118 so as to increase adhesive strength between the passivation layer 118 and the barrier layer 123. Then, the passivation layer 118 and the insulation layer 112 are etched sequentially so as to form a trench 113 that exposes the top surface of the substrate 110. Alternatively, the trench 113 may be formed by etching an upper portion of the substrate 110 to a predetermined depth. Then, the barrier layer 123 and the ink chambers 122 in the chamber layer 120 may be formed on the passivation layer 118. The barrier layer 123 may be formed by forming a predetermined material layer on the passivation layer 118, and then patterning the predetermined material layer. Accordingly, the plurality of ink chambers 122 filled with ink to be discharged are formed in the chamber layer 120 adjacent the ink chamber layer barriers 123. During this process, the plurality of restrictors 124, which are paths connecting the ink chambers 122 to the ink feedhole 111 of FIG. 13, may be formed in the chamber layer 120.

Figure 6:
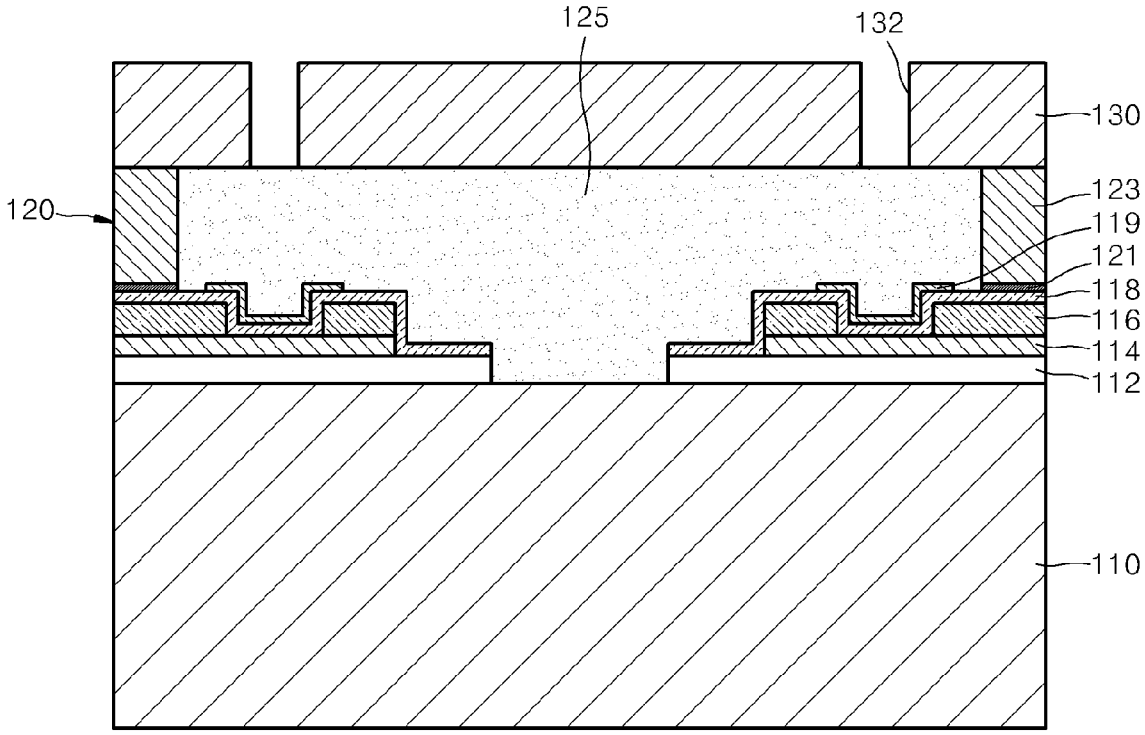

Referring to FIG. 6, a sacrificial layer 125 is formed within the chamber layer 120 between the barriers 123 so as to fill the trench 113, the ink chambers 122, and the restrictors 124. Then, top surfaces of the sacrificial layer 125 and the barrier layer 123 are planarized via, for example, a chemical mechanical polishing (CMP) process. The nozzle layer 130 including the nozzles 132 is formed above the chamber layer 120 and on the top surfaces of the sacrificial layer 125 and barriers 123. The nozzle layer 130 may be formed by forming a predetermined material layer on the top surfaces of the chamber layer 120, barriers 123, and the sacrificial layer 125. The nozzle layer 130 including nozzles 132 may then be formed by patterning, selective deposition, etching or other known processes. Accordingly, the plurality of nozzles 132 discharging ink are formed in the nozzle layer 130.

Figure 7:
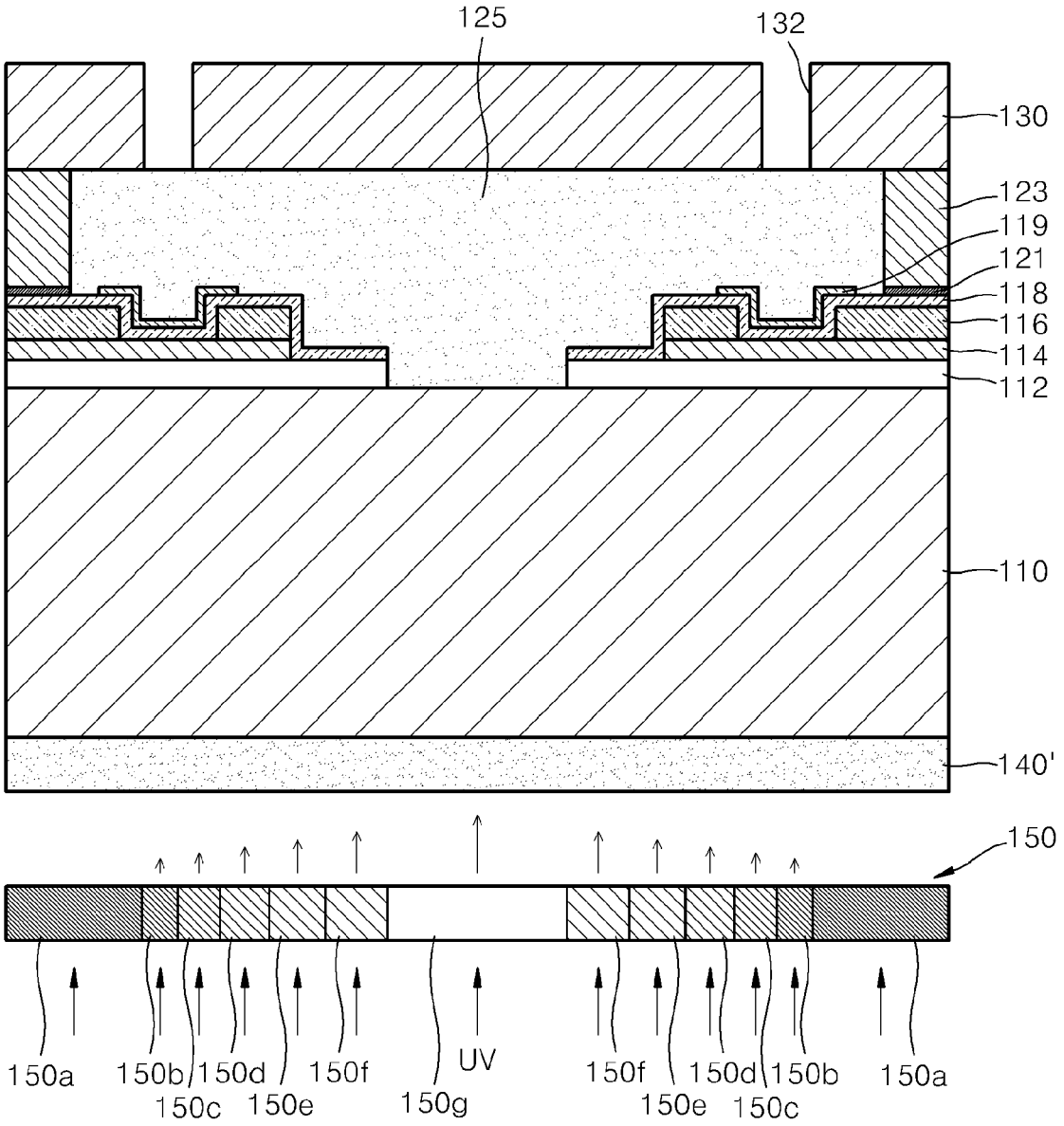
Figure 8:
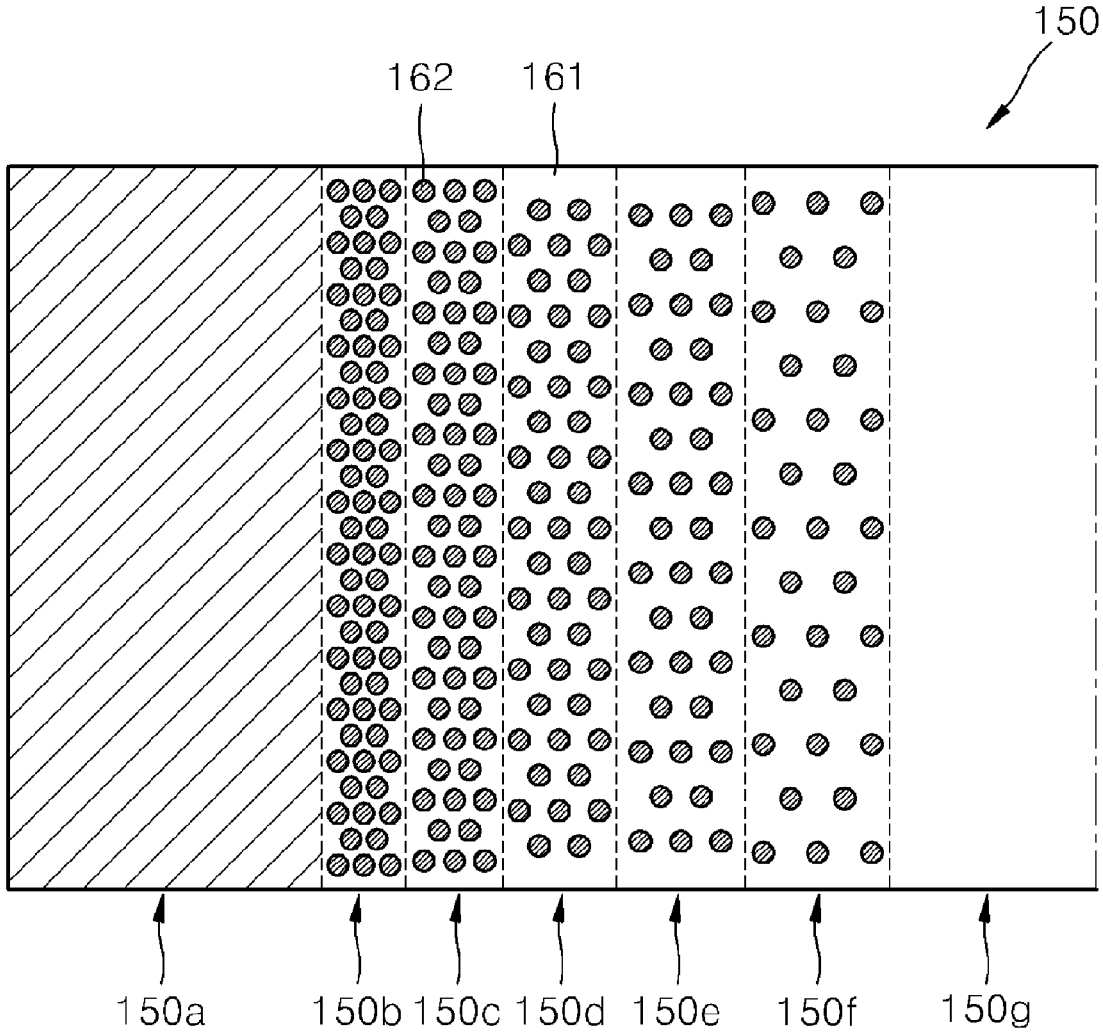

Referring to FIG. 7, a photoresist 140' having a predetermined thickness is formed on a bottom surface 110*b* of the substrate 110. Here, the photoresist 140' may be a positive photoresist as an example. A gray scale etching mask 150 may be prepared below the photoresist 140'. FIG. 8 is a plan view of a part of the gray scale etching mask 150. Referring to FIGS. 7 and 8, the gray scale etching mask 150 may include areas 150*a* through 150*g* having different light transmittances. In detail, the gray scale etching mask 150 includes a light blocking area 150*a*, a light totally transmitting area 150*g*, and a plurality of light partially transmitting areas 150*b*, 150*c*, 150*d*, 150*e*, and 150*f* illustrated in FIG. 8 that are disposed between the light blocking area 150*a* and the light totally transmitting area 150*g*. The light partially transmitting areas 150*b*, 150*c*, 150*d*, 150*e*, and 150*f* include a plurality of dots 162 disposed in a predetermined manner on a transparent substrate 161. The dots 162 may be formed of a light blocking material, such as chromium (Cr). Here, the light transmittances of the light partially transmitting areas 150*b*, 150*c*, 150*d*, 150*e*, and 150*f* may be adjusted by adjusting intervals or spaces between the dots 162 as illustrated in FIG. 8, or by adjusting sizes of the dots 162. The dots 162 may be disposed on one layer or in multiple layers in a vertical direction depending on the thickness of the etching mask 150. When the photoresist 140' is exposed to light via the gray scale etching mask 150, light exposed areas respectively corresponding to the areas 150*b* through 150*g* are formed in the photoresist 140'.

Depending on the desired configuration of the internal walls, the width of the areas 150*a* to 150*g* may be varied. More specifically, the width of the light blocking areas 150*a* may be varied to set an outer limit or boundary to coincide with the back 110*b* of the substrate. Also, depending on the number of steps desired in the substrate 110, the width and number of partial light transmission areas 150*b* to 150*f* may be formed. If more steps with smaller heights are desired, partial light transmission areas with smaller widths than illustrated in FIG. 7 may be formed. Alternatively, if fewer steps with larger stepping heights are desired, the partial light transmission areas may be formed to be wider than illustrated in FIG. 7. Also, the width of the light total transmitting area 150*g* may be varied to coincide with the width of the trench 113 to further configure the inkhole 111 to a desired size. Also, the dimensions of the steps formed in the substrate 110 may be varied such that the length and width of the different steps may not be of equal distance.

Figure 9:
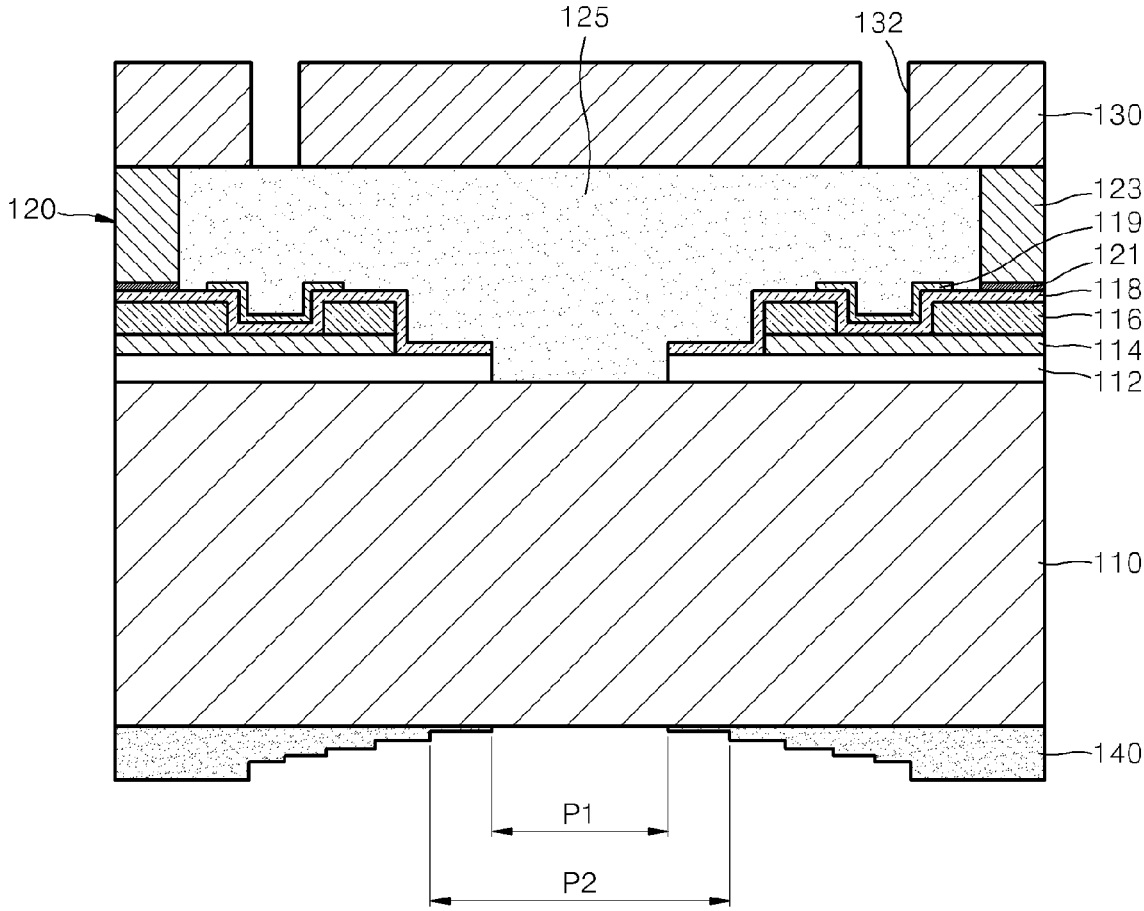

Referring to FIGS. 7-9, when the light exposed areas of the photoresist 140' are removed by developing the light exposed areas, a developed photoresist 140 including a plurality of steps P1, P2, etc. in the developed photoresist 140 to correspond to the areas 150*a* through 150*g*, of the gray scale etching mask 150, having different light transmittances is formed. Then, the bottom surface of the substrate 110 is dry-etched by using the developed photoresist 140 as an etching mask. The dry-etching may be inductively coupled plasma-reactive ion etching (ICP-RIE), but is not limited thereto.

Figure 10:
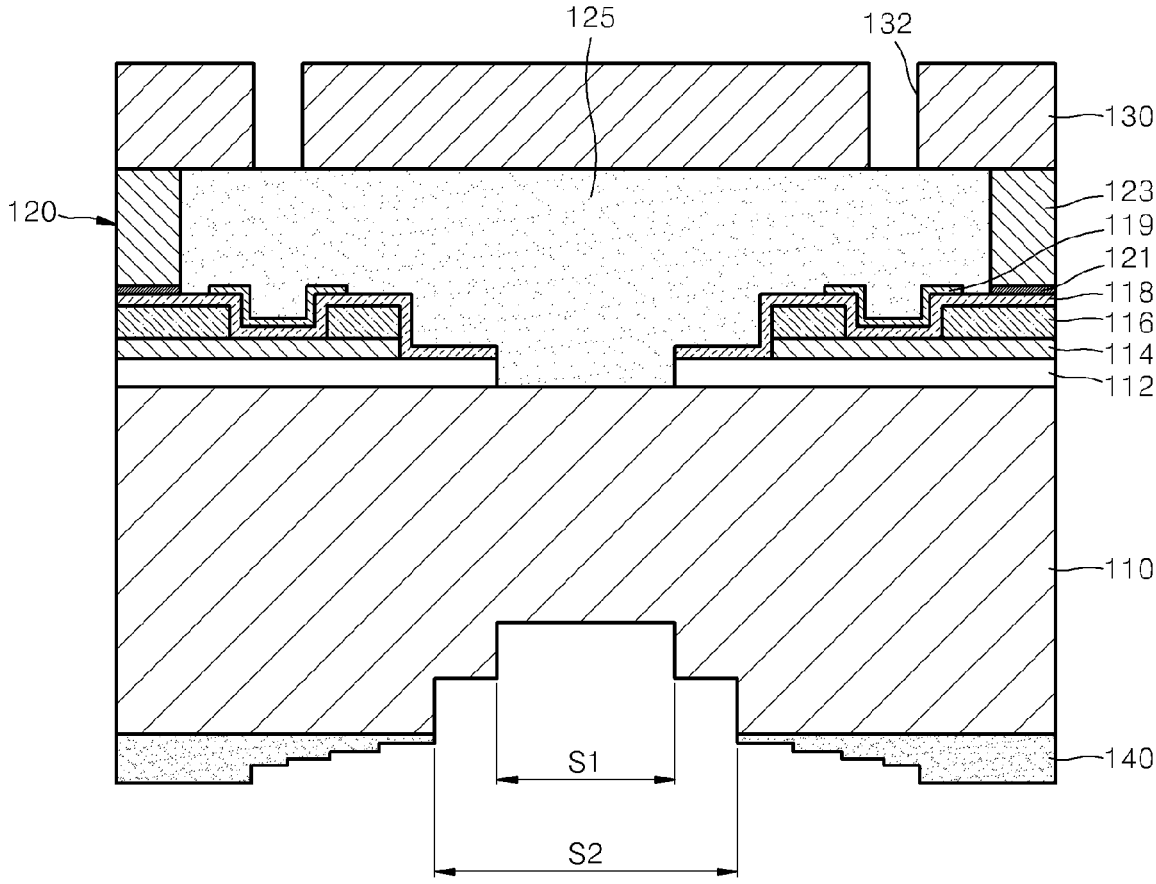
Figure 11:
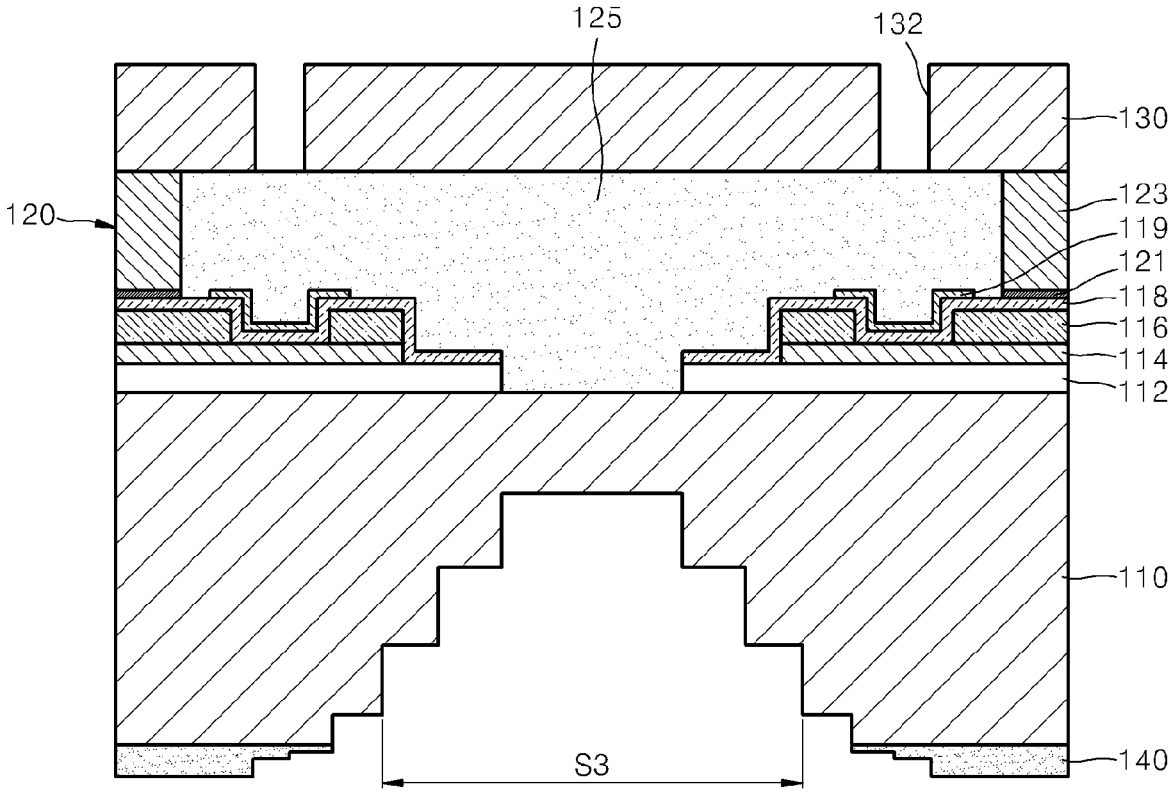

As such, when the bottom or back surface 110*b* of the substrate 110 is dry-etched by using the developed photoresist 140 as an etching mask, the bottom surface 110*b* of the substrate 110 may start to be etched in step increments S1 and S2 as illustrated in FIG. 10 due to the steps of the developed photoresist 140. When such a dry-etching process continues, the bottom surface 110*b* of the substrate 110 is progressively etched in step increments such as S3, etc. as illustrated in FIG. 11.

As the substrate 110 is progressively etched, the width and height of the initial steps S1 and S2 remain as configured with the developed photoresist 140 illustrated in FIG. 9 as the depth of the etched steps moves nearer to the front surface 110*a* of the substrate 110. Similarly, the widths and heights of the other steps remain consistent during the progressive etching process. Also, if the width of the areas 150*a* to 150*g* may be altered to be narrower or wider, the steps S1, S2, S3, etc. will correspond with a corresponding developed photoresist 140 to form the desired number and size of steps of an inclined internal wall. Meanwhile, the thickness of the developed photoresist 140 formed on the bottom surface of the substrate 110 decreases due to the dry-etching process.

Figure 12:
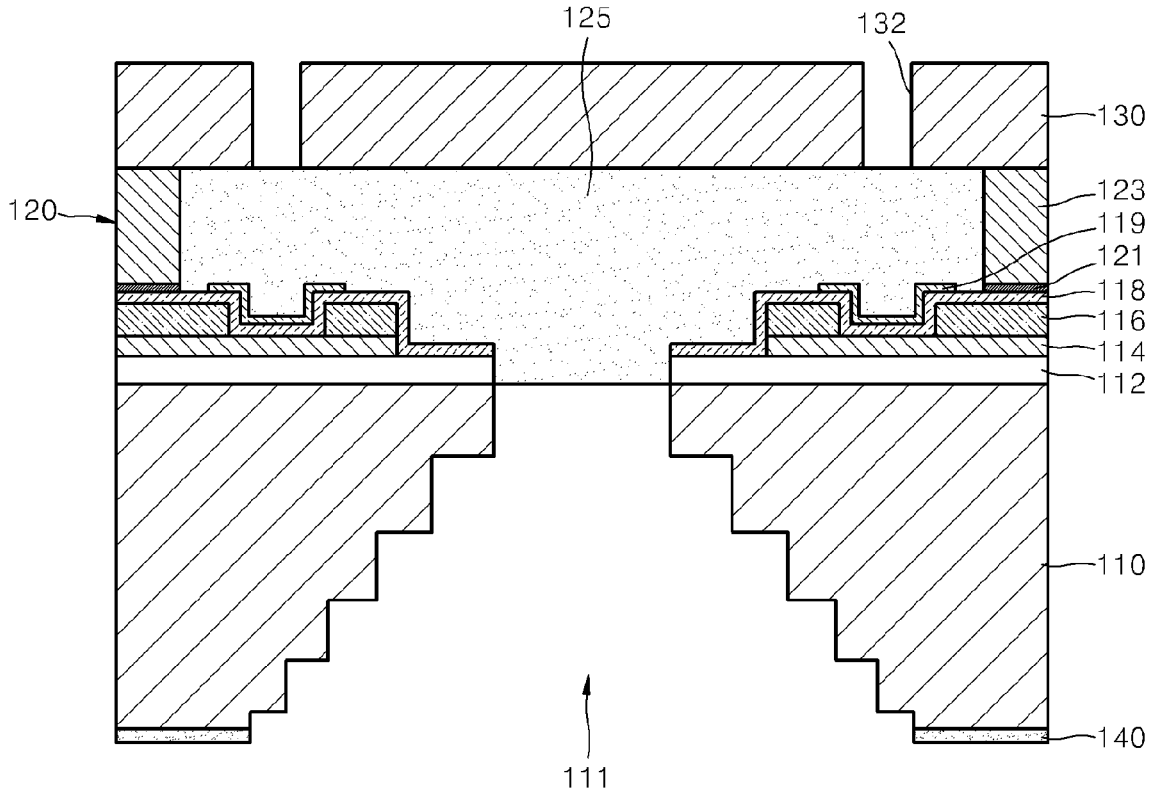

When the substrate 110 is dry-etched until the sacrificial layer 125 filled in the trench 113 of FIG. 12 is exposed, the ink feedhole 111 penetrating the substrate 110 is formed as illustrated in FIG. 12. Here, the width of the ink feedhole 111 narrows in the upper direction of the substrate 110. Also, the internal walls of the ink feedhole 111 include a plurality of steps S1, S2, S3, etc. (illustrated in FIGS. 9 and 10) in the substrate 110 to correspond to the steps P1, P2, etc. (illustrated in FIG. 11) of the developed photoresist 140, and are inclined with respect to the surfaces 110*a* and 110*b* of the substrate 110. Here, the internal walls of the ink feedhole 111 may be formed symmetrically with respect to a central surface between the internal walls. An angle θ of inclination of the internal walls may be in a range from about 54.7° to about 90° as illustrated in FIG. 2, but is not limited thereto, and may be variously adjusted. Next, the developed photoresist 140 left on the bottom surface of the substrate 110 is removed.

Figure 13:
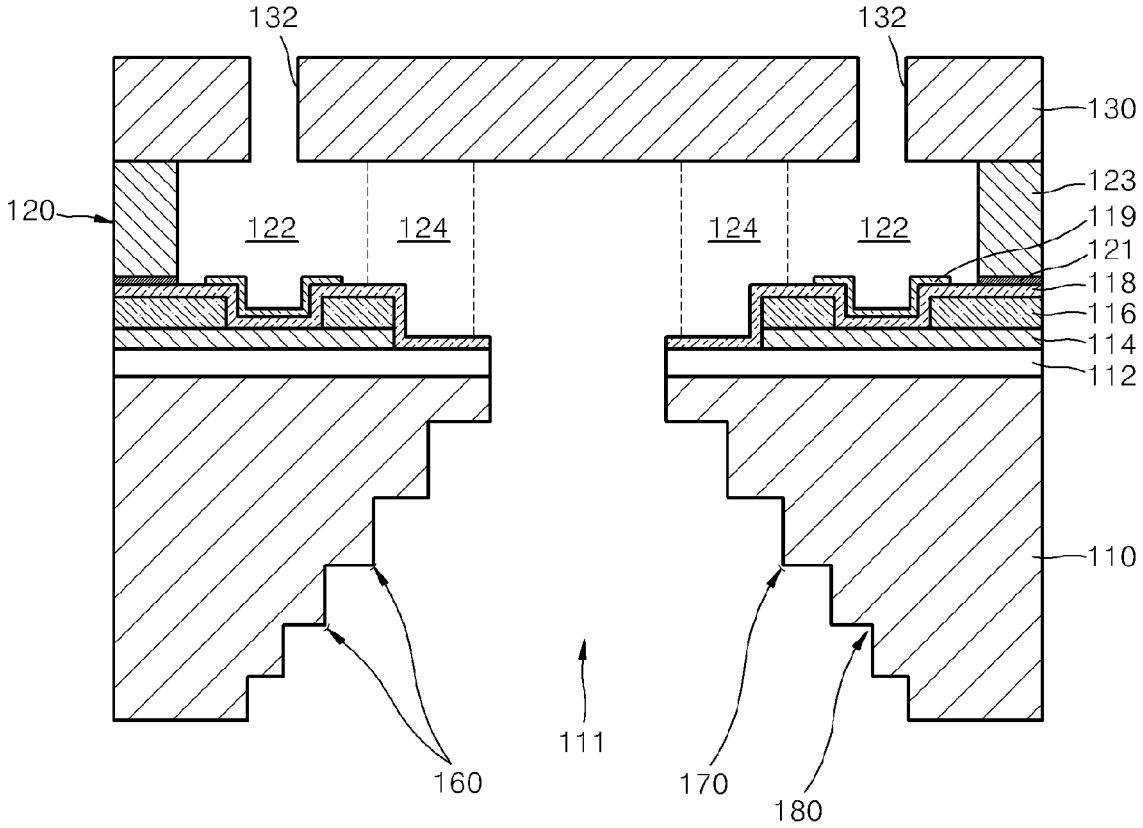

Referring to FIG. 13, the inkjet printhead is prepared by removing the sacrificial layer 125 filled in the trench 113, the ink chamber 122, and the restrictors 124. Here, the sacrificial layer 125 may be removed by injecting an etchant that selectively etches the sacrificial layer 125, via the nozzles 132 and the ink feedhole 111.

FIG. 13 illustrates two examples of protrusions 160 that are formed the length of the internal inclined wall. Though the protrusions 160 are the steps are illustrated as sharp edges, the protrusions are not limited to that shape and may have rounded corners or edges. Similarly, the plurality of steps also includes concave portions 170 and convex portions 180 that are not limited to having sharp corners as illustrated in FIG. 13, and may also have rounded concave and convex shapes.

Meanwhile, the photoresist 140' formed on the bottom surface of the substrate 110 is a positive photoresist, but alternatively, the photoresist 140' may be a negative photoresist. Also, the steps formed on the internal walls of the ink feedhole 111 may be variously adjusted by changing the number of light partially transmitting areas of the gray scale etching mask 150, and the angle of inclination of the internal walls of the ink feedhole may be variously adjusted by adjusting the light transmittances of the light partially transmitting areas. Also, the internal walls of the ink feedhole 111 that face each other are formed symmetrically with respect to the central surface of the internal walls, but alternatively, the width of the ink feedhole 111 may narrow in an upper direction of the substrate 110, and the internal walls of the ink feedhole 111 may be formed asymmetrically with respect to the central surface. For example, the areas 150*a* through 150*g*, of the gray scale etching mask 150, having different light transmittances may be deformed in such a way that one internal wall of the ink feedhole is perpendicular to a surface of the substrate 110 and the other internal wall inclines with respect to the surface of the substrate 110. Here, the other internal wall that is inclined may include a plurality of steps.

According to the embodiments of the present general inventive concept, an angle of inclination of an internal wall of an ink feedhole may be adjusted via dry-etching using a gray scale photomask. Accordingly, an inkjet printhead having a strong structure may be manufactured and an ink discharge characteristic of the inkjet printhead is increased.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims.

What is claimed is:

1. A method of forming an ink feedhole that penetrates a substrate and has a width narrowing in an upper direction of the substrate, wherein at least one internal wall of the ink feedhole is formed to have a plurality of steps that extend in another direction perpendicular to the upper direction and incline with respect to a surface of the substrate via dry-etching.

2. The method of claim 1, comprising:

coating a photoresist on a bottom surface of the substrate;

preparing a photomask that comprises areas having different light transmittances from each other below the photoresist;

exposing the photoresist to light via the photomask and developing the photoresist; and dry-etching the substrate using the developed photoresist as an etching mask.

3. The method of claim 2, wherein the developed photoresist comprises a plurality of steps corresponding to the areas having different light transmittances from each other.

4. The method of claim 2, wherein an angle of inclination of the at least one internal wall is in a range from about 54.7° to about 90° with respect to the surface of the substrate.

5. The method of claim 2, wherein the dry-etching is inductively coupled plasma-reactive ion etching (ICP-RIE).

6. A method of manufacturing an inkjet printhead, the method comprising:

forming a chamber layer comprising a plurality of ink chambers, on a substrate;

forming a sacrificial layer filling the ink chambers;

forming a nozzle layer comprising a plurality of nozzles on top surfaces of the chamber layer and the sacrificial layer; and forming an ink feedhole having a width narrowing in an upper direction of the substrate, by etching the substrate, wherein at least one internal wall of the ink feedhole is formed to have a plurality of steps that extend in another direction perpendicular to the upper direction and incline with respect to a surface of the substrate via dry-etching.

7. The method of claim 6, wherein the forming of the ink feed hole comprises:

coating a photoresist on a bottom surface of the substrate;

preparing a photomask that comprises areas having different light transmittances from each other below the photoresist;

exposing the photoresist to light using the photomask, and developing the photoresist; and dry-etching the substrate using the developed photoresist as an etching mask.

8. The method of claim 6, wherein an angle of inclination of the at least one internal wall is in a range from about 54.7° to about 90° with respect to the surface of the substrate.

9. The method of claim 6, wherein internal walls of the ink feedhole that face each other symmetrically incline with respect to a central surface between the internal walls.

10. The method of claim 6, wherein one of the internal walls, which face each other is perpendicular to a surface of the substrate, and the other internal wall inclines with respect to the surface of the substrate.

11. The method of claim 6, further comprising removing the sacrificial layer, after forming the ink feedhole.

12. The method of claim 6, further comprising:

forming an insulation layer on the substrate;

forming, sequentially, a plurality of heaters and electrodes on the insulation layer; and forming a passivation layer covering the plurality of heaters and electrodes.

13. The method of claim 12, further comprising forming a trench that exposes the substrate, by etching the passivation layer and the insulation layer.

14. The method of claim 7, wherein the developed photoresist comprises a plurality of steps corresponding to the areas having different light transmittances from each other.

* * * * *